US006886830B1

(12) United States Patent
Boyd

(10) Patent No.: US 6,886,830 B1
(45) Date of Patent: May 3, 2005

(54) METHOD AND APPARATUS FOR PLAYING A DICELESS CRAPS GAME

(75) Inventor: David A. Boyd, Reno, NV (US)

(73) Assignee: Red Door Enterprises, LLC., Encino, CA (US)

( * ) Notice: Subject to any disclaimer, the term of this patent is extended or adjusted under 35 U.S.C. 154(b) by 0 days.

(21) Appl. No.: 10/612,327

(22) Filed: Jul. 1, 2003

Related U.S. Application Data

(63) Continuation-in-part of application No. 10/003,722, filed on Nov. 1, 2001, now Pat. No. 6,749,199.
(60) Provisional application No. 60/304,648, filed on Jul. 10, 2001.

(51) Int. Cl.[7] ..... A63F 1/00
(52) U.S. Cl. ..... 273/292
(58) Field of Search ..... 273/274, 292, 273/303; 463/12

(56) References Cited

U.S. PATENT DOCUMENTS

| | | | | | |
|---|---|---|---|---|---|
| 4,746,126 | A | * | 5/1988 | Angileri | 273/249 |
| 5,350,175 | A | | 9/1994 | DiLullo et al. | 273/146 |
| 5,487,547 | A | * | 1/1996 | Hobert | 273/274 |
| 5,676,375 | A | | 10/1997 | Pirouzkhah | 273/274 |
| 5,690,337 | A | | 11/1997 | Somma et al. | 273/309 |
| 5,770,533 | A | | 6/1998 | Franchi | 463/42 |
| RE35,864 | E | | 7/1998 | Weingardt | 463/28 |
| 5,788,240 | A | * | 8/1998 | Feinberg | 273/274 |
| 5,788,574 | A | | 8/1998 | Ornstein et al. | 463/25 |
| 5,831,527 | A | | 11/1998 | Jones, II et al. | 340/540 |
| 5,842,698 | A | | 12/1998 | Brown | 273/292 |
| 5,934,676 | A | * | 8/1999 | Rubin | 273/309 |
| 5,961,119 | A | | 10/1999 | Brown | 273/292 |
| 5,964,463 | A | | 10/1999 | Moore, Jr. | 273/274 |
| 6,019,373 | A | * | 2/2000 | Brown | 273/274 |
| 6,154,131 | A | | 11/2000 | Jones, II et al. | 340/540 |
| 6,165,072 | A | | 12/2000 | Davis et al. | 463/29 |
| 6,176,489 | B1 | | 1/2001 | Astaneha | 273/274 |
| 6,179,291 | B1 | | 1/2001 | Vancura | 273/292 |
| 6,203,427 | B1 | | 3/2001 | Walker et al. | 463/16 |
| 6,206,373 | B1 | | 3/2001 | Garrod | 273/292 |
| 6,237,916 | B1 | | 5/2001 | Webb | 273/292 |
| 6,386,973 | B1 | | 5/2002 | Yoseloff | 463/13 |
| 6,390,474 | B1 | | 5/2002 | Terminel et al. | 273/292 |
| 6,435,505 | B1 | | 8/2002 | Hoffman | 273/274 |
| 6,655,689 | B1 | * | 12/2003 | Stasi | 273/274 |
| 6,688,597 | B2 | * | 2/2004 | Jones | 273/274 |
| 6,692,003 | B2 | * | 2/2004 | Potter et al. | 272/274 |
| 2001/0035604 | A1 | | 11/2001 | Jones | 273/139 |
| 2001/0042960 | A1 | | 11/2001 | Lewis et al. | 273/274 |

OTHER PUBLICATIONS

John Scarne, *Scarne's Encyclopedia of Games*, Harper & Row, pp. 319–321, 455–471, 1973. (No month).

* cited by examiner

*Primary Examiner*—Kurt Fernstrom
(74) *Attorney, Agent, or Firm*—Sierra Patent Group, Ltd.

(57) ABSTRACT

A dice-less Craps game is disclosed. The game may be played by dealing a first card and a second card from a plurality of cards; determining whether the first card and the second card are of the same suit; if the first and second cards are not of the same suit, then adding the numerical values of the first card and the second card to determine a roll in accordance with the rules of Craps; if the first and second cards are of the same suit, then paying a predetermined result; determining whether the first and second cards match an additional criteria; and if the first and second cards match an additional criteria, paying an additional result.

8 Claims, 7 Drawing Sheets

METHOD AND APPARATUS FOR PLAYING A DICELESS CRAPS GAME

CROSS REFERENCE TO RELATED APPLICATIONS

This application is a Continuation-In-Part of U.S. patent application Ser. No. 10/003,722, filed Nov. 11, 2001, now U.S. Pat. No. 6,749,199 which claims the benefit of U.S. Provisional Application Ser. No. 60/304,648, filed Jul. 10, 2001.

BACKGROUND OF THE DISCLOSURE

I. Field

The present disclosure relates to card games, and in particular, to a method and apparatus for playing a dice-less Craps game.

II. Background

Craps is one of the most popular dice games played in the casinos of Nevada and New Jersey. Players and spectators alike enjoy the fast-paced action provided by Craps.

However, in some areas of the country dice games are prohibited, while other types of games, such as card games, slot machines, or keno, may be permitted. In such jurisdictions, the absence of Craps on the casino floor may be missed.

Card games designed to replicate dice games are known in the art. For example, the *Official World Encyclopedia of Sport and Games,* 1979, discloses a craps game that is played with a deck of cards.

The game uses a special deck of 48 cards, consisting of two sets of each of the denominations Ace, 2, 3, 4, 5 and 6. The numerical value of the cards corresponds to the indicia on the faces of two dice.

The shooter deals two cards from the top of the deck face up onto the table, constituting a throw. The value of the two cards added together is a "roll" in the same way as the two dice in dice craps. Play follows the basic rules for Craps, where the first two cards on a come-out give either a natural (7 or 11), a craps (2, 3, or 12), or a point (4, 5, 6, 8, 9 or 10).

After every come-out throw the two cards are shuffled back into the deck by the shooter, and the deck is cut. This happens even if no decision has been reached (e.g. if a point has been thrown). If the shooter then still has to make a point, he deals further throws, but does not shuffle these back into the deck.

This continues until he makes the point or sevens out. The entire deck is then shuffled together and cut. If, on a point, the entire deck is exhausted, the deck is reshuffled and cut by the shooter; he then continues, trying for the same point.

The prior art card games suffer from certain disadvantages, however. For example, since cards are not returned to the deck while the shooter is trying to make a point, the odds of the game are not equivalent to a true Craps dice game since the rolls represented by the used cards are not available.

SUMMARY

A dice-less Craps game is disclosed. The game may be played by dealing a first card and a second card from a plurality of cards; determining whether the first card and the second card are of the same suit; if the first and second cards are not of the same suit, then adding the numerical values of the first card and the second card to determine a roll in accordance with the rules of Craps; if the first and second cards are of the same suit, then paying a predetermined result; determining whether the first and second cards match an additional criteria; and if the first and second cards match an additional criteria, paying an additional result.

An apparatus for playing a dice-less Craps game is disclosed comprising: a Craps playing surface for receiving a pair of dealt playing cards, the playing surface having indicia thereon for wagering on a predetermined result other than a roll in accordance with the rules of Craps.

In a further disclosed aspect an apparatus for playing a dice-less Craps game is disclosed, comprising a deck of cards comprising 48 cards having numerical indicia thereon including four like-suited pairs each of Aces, Twos, Threes, Fours, Fives, and Sixes; and a Craps playing surface having additional indicia thereon for wagering on a predetermined result if a pair of dealt cards are of a like suit.

In additional aspect of a disclosed dice-less Craps game, a pair of dealt cards may be drawn from a deck consisting of 48 cards including four like-suited pairs each of Aces, Twos, Threes, Fours, Fives, and Sixes. The dealt pair of cards may be returned to the deck prior to the dealer dealing a subsequent pair of cards.

It is contemplated that the disclosed game may be embodied in computerized gaming equipment.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION

Persons of ordinary skill in the art will realize that the following description is illustrative only and not in any way limiting. Other modifications and improvements of the invention will readily suggest themselves to such skilled persons having the benefit of this disclosure.

It is contemplated that the various aspects of the disclosure may be embodied in various computer and machine readable data structures. Furthermore, it is contemplated that data structures embodying various aspects of the disclosure may be transmitted across computer and machine-readable media, and through communications systems by use of standard protocols such as those used to enable networked computer systems.

The disclosure may further relate to machine-readable media on which are stored embodiments of various aspects of the disclosure. It is contemplated that any media suitable for storing instructions related to aspects of the disclosure is within the scope of the present disclosure. By way of example, such media may take the form of magnetic, optical, or semiconductor media.

Various aspects of the disclosure may be described through the use of flowcharts. Often, a single instance may be shown. As is appreciated by those of ordinary skill in the art, however, the protocols, processes, and procedures described herein may be repeated continuously or as often as necessary. Accordingly, the representation of various aspects of the disclosure through the use of flowcharts should not be used to limit the scope of the present disclosure.

Exemplary embodiments of disclosed apparatus and methods may be disclosed herein. The word "exemplary" is used exclusively herein to mean "serving as an example, instance, or illustration." Any embodiment described as an "exemplary embodiment" is not to be construed as necessarily preferred or advantageous over other embodiments described herein.

Figure 1:
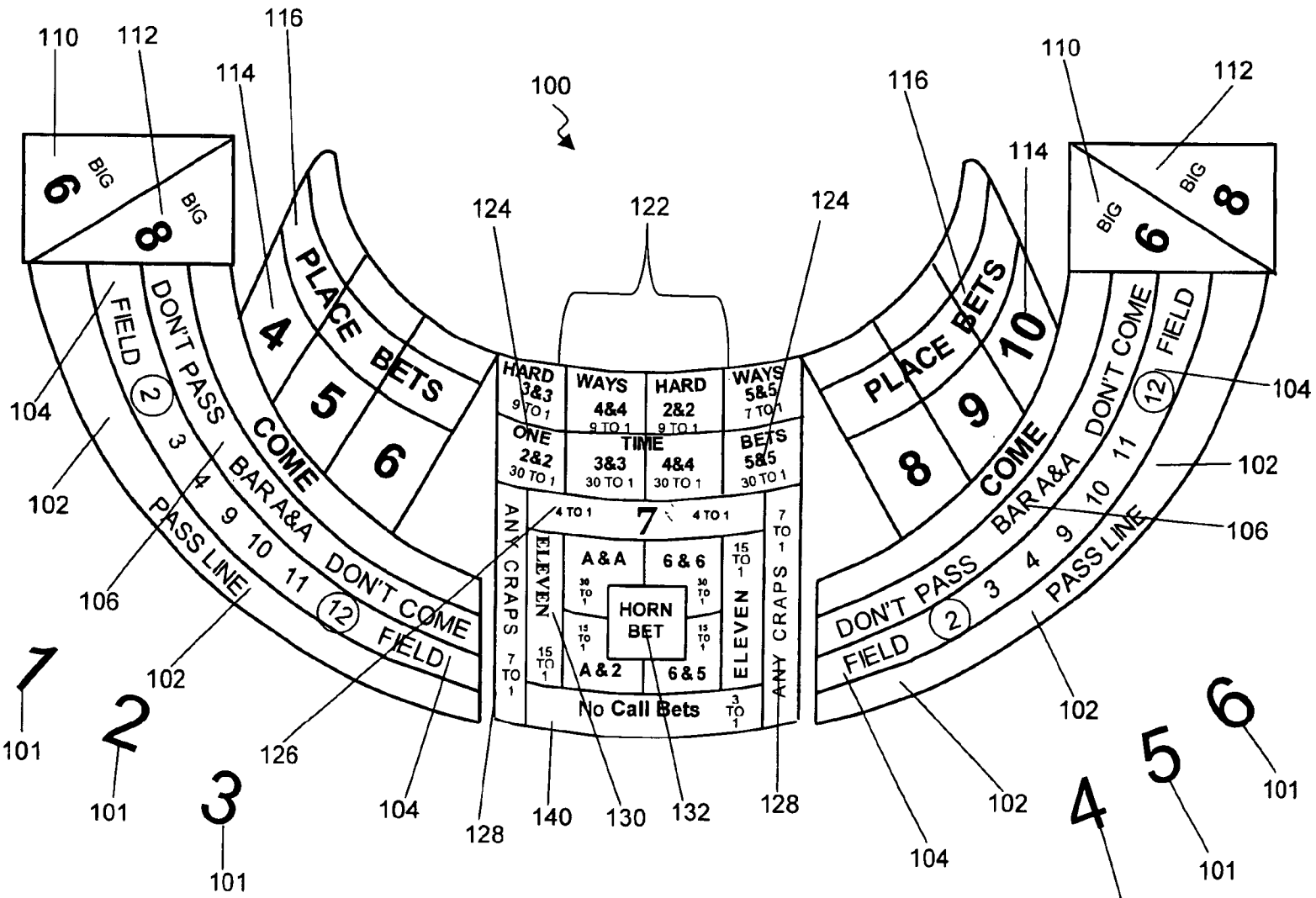
FIG. 1 is one aspect of a disclosed game playing surface.

Referring now to FIG. 1, a playing surface 100 for a dice-less Craps game according to one aspect of the present disclosure is shown. The surface 100 may be any real or simulated surface. For example, the surface 100 may comprise a pre-printed felt covering mounted on a gaming table as is known in the art. The surface 100 may also comprise a pre-printed game board for home use. Alternatively, the surface 100 may be simulated on a video screen with the game as described herein being played under computer control using hardware and software as is known in the art.

The playing surface 100 may include one or more player position indicia 101. Though indicia for six players are shown on the playing surface 100, it is contemplated that indicia may be provided for any number of players.

The playing surface 100 may include Craps wagering indicia corresponding to a standard Craps game as is known in the art. For example, the playing surface 100 may include:

Place bet indicia 116 for placing place wagers;

Hardways indicia 122 for placing wagers on the hardways;

Big 6 indicia 110 for placing Big 6 wagers;

Big 8 indicia 112 for placing Big 8 wagers;

Pass line indicia 102 for placing pass wagers;

Field indicia 104 for placing field wagers;

Don't pass indicia 106 for placing Don't Pass or Don't Come wagers;

Come indicia 108 for placing Come wagers;

Any Seven indicia 126 for placing Any Seven wagers;

Any Craps indicia 128 for placing Any Craps wagers;

Any Eleven indicia 130 for placing Any Eleven wagers;

Place bet number indicia 114 for placing place bet number wagers;

Hopping hard ways indicia 124 for placing hopping hard ways wagers;

NoCall indicia 140 for placing NoCall wagers; or

Horn indicia 132 for placing wagers on the Horn.

It is contemplated that the playing surface 100 may include any other indicia as may be needed to facilitate a Craps game as is known in the art. For example, as is shown in FIG. 1, one or more of the Craps indicia on the playing indicia 100 may have corresponding wagering odds indicated nearby. The individual odds noted in FIG. 1 are intended to serve as exemplary examples and it is contemplated that a wide variety of desired odds may be indicated on the playing surface 100. Furthermore, it is contemplated that Craps wagering indicia other than those shown in FIG. 1 may be provided on the playing surface 100 to provide other Craps wagering opportunities as may be known in the art.

The playing surface 100 together with the Craps wagering indicia as shown as described herein form a Craps playing surface suitable for use with the game of present disclosure.

The playing surface 100 may further include indicia 130 for placing wagers on a predetermined result other than a Craps roll. The criteria for the wager represented by the indicia 130 will be discussed in more detail below.

Figure 2:
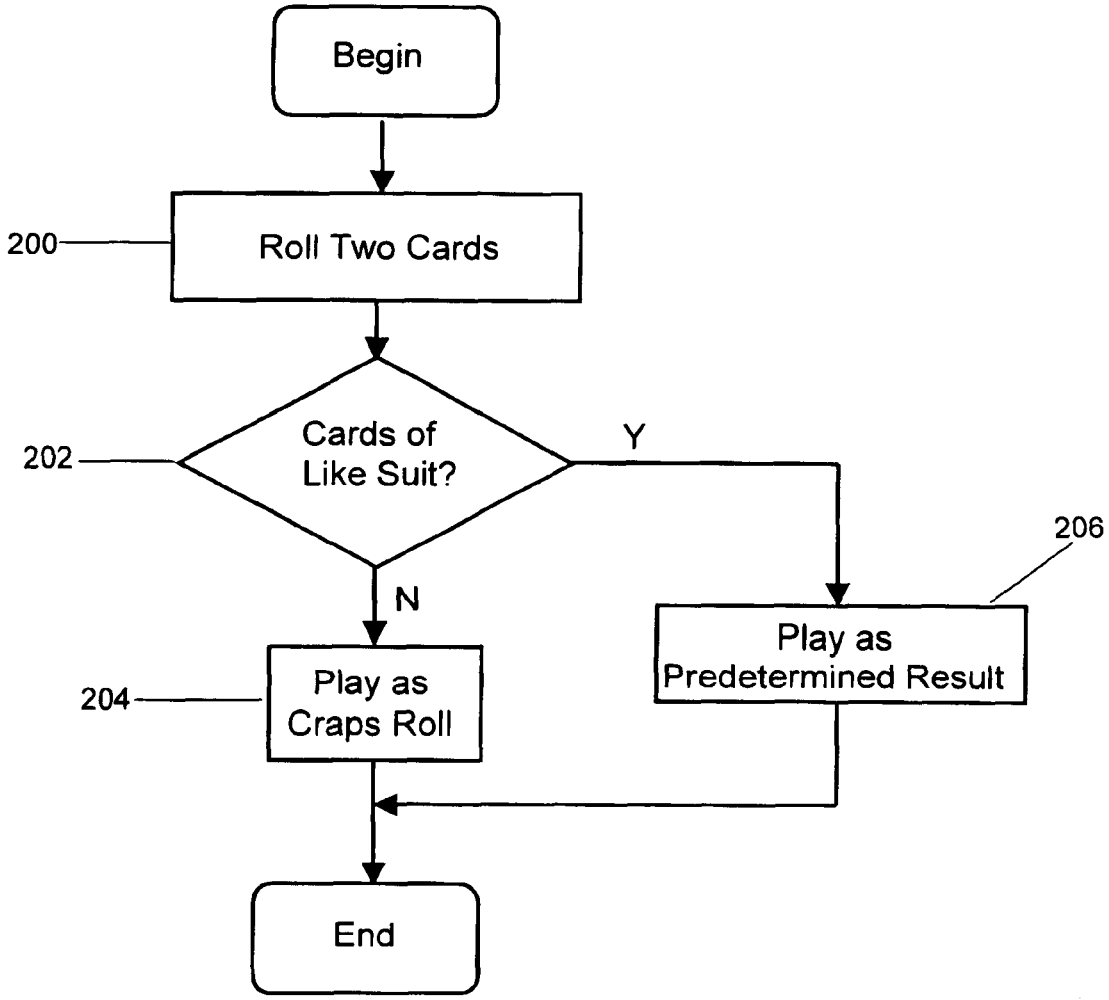
FIG. 2 is a flowchart of one disclosed aspect of a dice-less Craps game.

Referring now to FIG. 2, a flowchart of one aspect of a disclosed dice-less Craps game is shown. The method of FIG. 2 may be played on the playing surface 100 of FIG. 1.

Beginning with act 200, two cards are dealt. In a manual version of the disclosed game, a dealer may deal the card. In a simulated game, the cards may be dealt under computer control. The cards may be manually shuffled by a dealer, an automatic shuffling machine, or by a computer.

In one aspect of a disclosed game, the deck of cards from which the pair of cards in act 200 is dealt comprises a 48-card deck. In the deck, six denominations of cards are provided which correspond to the indicia of a die, e.g., 1 through 6. For each of the six numbers, eight cards are provided, for a total of 48 cards. In one disclosed aspect, standard playing cards are used with the denominations being Ace, 2, 3, 4, 5, and 6.

As mentioned above, one defect of the games of the prior art is that the odds or dice-less Craps games do not resemble those of true dice Craps. The game of the present disclosure achieves a much closer approximation of true dice Craps by utilizing the suits already present in a standard deck of cards. In one aspect of a disclosed game, the following deck may be provided as shown in Table 1:

TABLE 1

| Dice Indicia | Corresponding Card Indicia | Total Cards in Deck | No. of Cards by Suit |
|---|---|---|---|
| 1 | Ace | 8 | 2 Clubs; 2 Diamonds; 2 Hearts; 2 Spades |
| 2 | 2 | 8 | 2 Clubs; 2 Diamonds; 2 Hearts; 2 Spades |
| 3 | 3 | 8 | 2 Clubs; 2 Diamonds; 2 Hearts; 2 Spades |
| 4 | 4 | 8 | 2 Clubs; 2 Diamonds; 2 Hearts; 2 Spades |
| 5 | 5 | 8 | 2 Clubs; 2 Diamonds; 2 Hearts; 2 Spades |
| 6 | 6 | 8 | 2 Clubs; 2 Diamonds; 2 Hearts; 2 Spades |

To better track the odds of true dice Craps, after a pair of cards are dealt in act 200, it is determined whether the cards as dealt are of the same suit in query 202. If the dealt cards are not of a like suit, the dealt cards are treated as a "roll" of dice. The face value of the dealt cards are added together and played as a roll of the dice according to the rules of Craps in act 204. The dealer may then pay any wagers according to standard Craps rules.

If the query 202 determines that the dealt cards are of a like suit, then the game proceeds to act 206, where a predetermined result may be provided. In one aspect of a disclosed game, a predetermined result is provided which provides a result other than one provided in a standard game of Craps. This result is referred to as a "NoCall" herein. The NoCall aspect of the disclosed game may be indicated on the playing surface through an additional indicia such as indicia 130. The NoCall result may be the subject of additional wagers, and thus may have wagering indicia indicating the stated odds proximately located nearby. In one aspect of a disclosed game, the odds on a NoCall are 3 to 1.

In a further aspect of a disclosed game, after a roll is resolved in act 204, or a NoCall is resolved in act 206, the pair of dealt cards may be returned to the deck and reshuffled, further insuring the odds remain true.

Though cards from a standard deck of cards are used in one disclosed aspect, it is contemplated that cards with any indicia suitable for representing dice indicia and suits may be used. For example, cards with other numeric indicia may be used, such as representations of the face of dice, or stylized numerals. The suits may be represented by means other than the suits of standard playing cards, such as colors or other symbols. Additionally, the cards may be of any size or shape. As will be appreciated by those of ordinary skill in the art, the number of suits may be altered to change the odds of a NoCall to achieve a desired result, such as the overall odds of the game.

Figure 3:
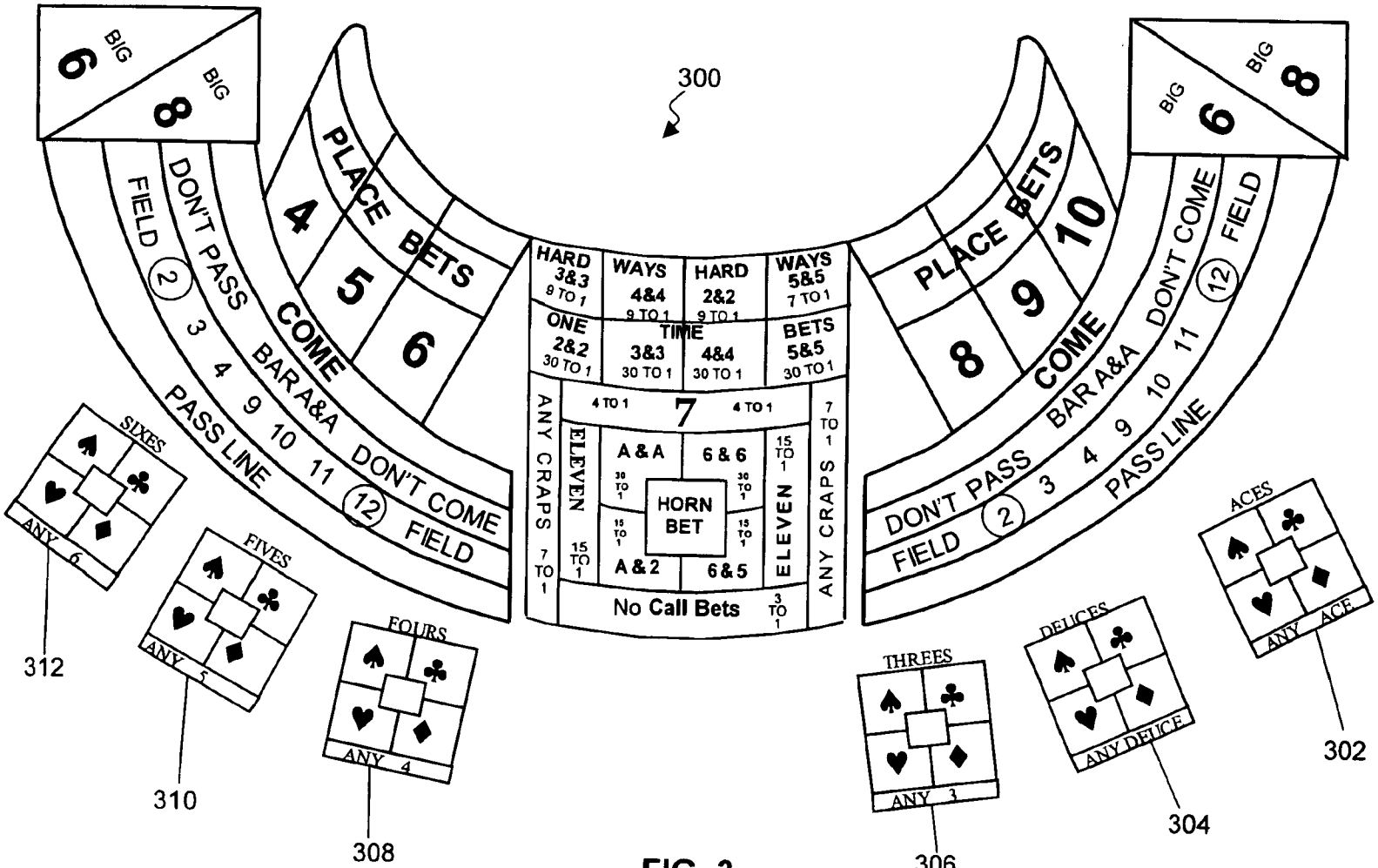
FIG. 3 is another aspect of a disclosed game playing surface with the NoCall wager for single suit card matches.

Referring now to FIG. 3, a playing surface 300 for a dice-less Craps game according to another aspect of the present disclosure is shown. As discussed above in FIG. 1, the surface 300 may be any real or simulated surface. For example, the surface 300 may comprise a pre-printed felt covering mounted on a gaming table as is known in the art. The surface 300 may also comprise a pre-printed game board for home use. Alternatively, the surface 300 may be simulated on a video screen with the game as described herein being played under computer control using hardware and software as is known in the art.

The playing surface 300 may include one or more player position indicia 102. Though indicia for six players are shown on the playing surface 100, it is contemplated that indicia may be provided for any number of players.

As in FIG. 1, the playing surface 300 may include Craps wagering indicia corresponding to a standard Craps game as is known in the art. For example, in addition to the indicia discussed in FIG. 1 the playing surface 300 may further include:

- Place bet indicia 302 for placing place wagers on NoCall, wherein the roll is the same suit and same card in this instance the ace;
- Place bet indicia 304 for placing place wagers on NoCall, wherein the roll is the same suit and same card in this instance the deuce;
- Place bet indicia 306 for placing place wagers on NoCall, wherein the roll is the same suit and same card in this instance the three;
- Place bet indicia 308 for placing place wagers on NoCall, wherein the roll is the same suit and same card in this instance the four;
- Place bet indicia 310 for placing place wagers on NoCall, wherein the roll is the same suit and same card in this instance the five;
- Place bet indicia 312 for placing place wagers on NoCall, wherein the roll is the same suit and same card in this instance the six.

Figure 4:
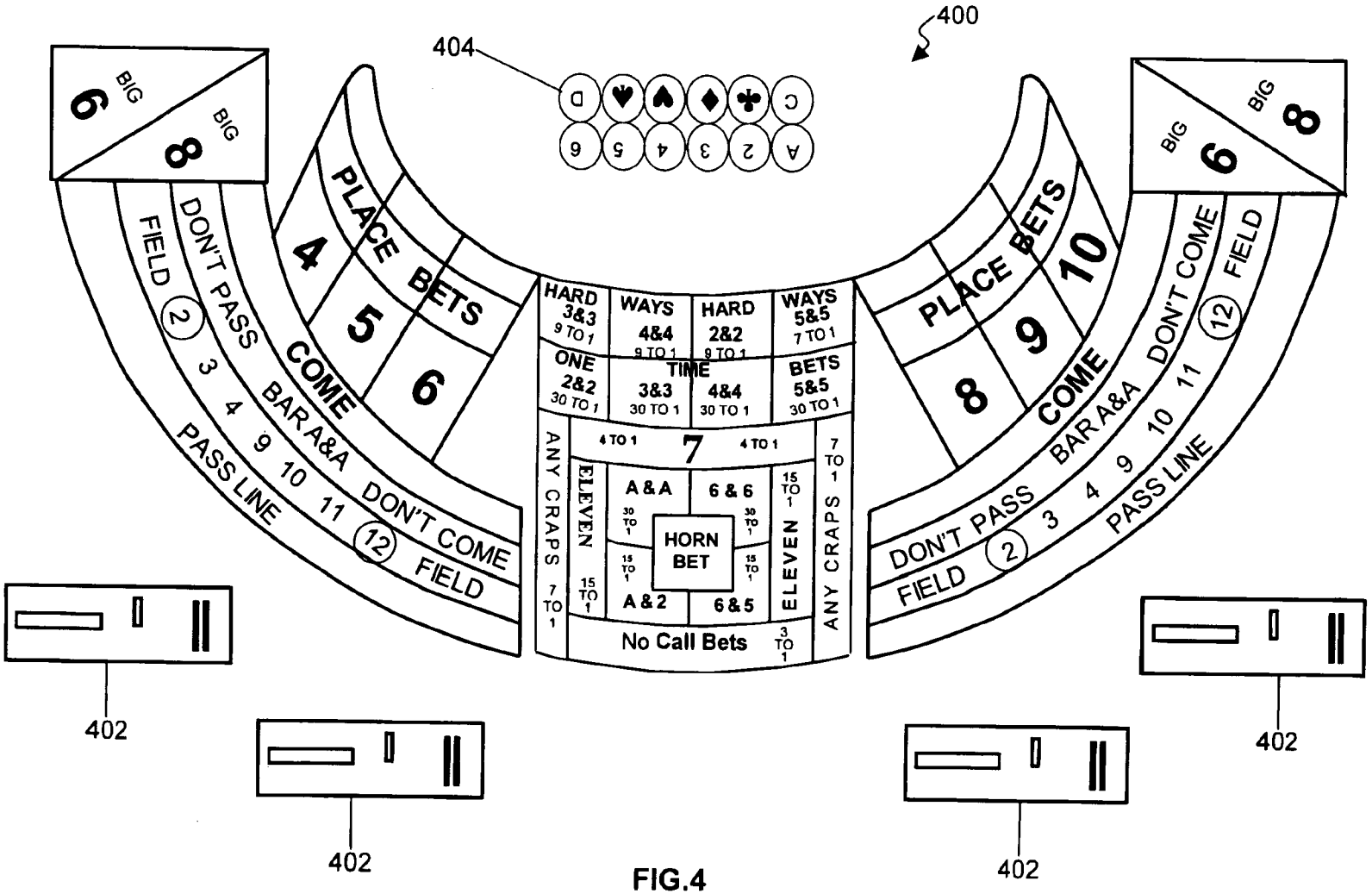
FIG. 4 is another aspect of a disclosed game playing surface with the NoCall wager for use with a bill acceptor or other means for monetary transactions.

Referring now to FIG. 4, a playing surface 400 for a dice-less Craps game according to another aspect of the present disclosure is shown. The present embodiment further includes a pay point 402 for accepting a monetary transaction without dealer intervention. The pay point 402 may include means for accepting bills, coins, credit cards or any other means known by those of ordinary skill in the art. Included in this embodiment is the player keypad 404 for selecting a particular craps wager without dealer intervention. Another feature of this embodiment is the dealer keypad 406 for use by the dealer to input the actual "roll" of the cards. These two aspects are discussed in greater detail below.

Figure 5:
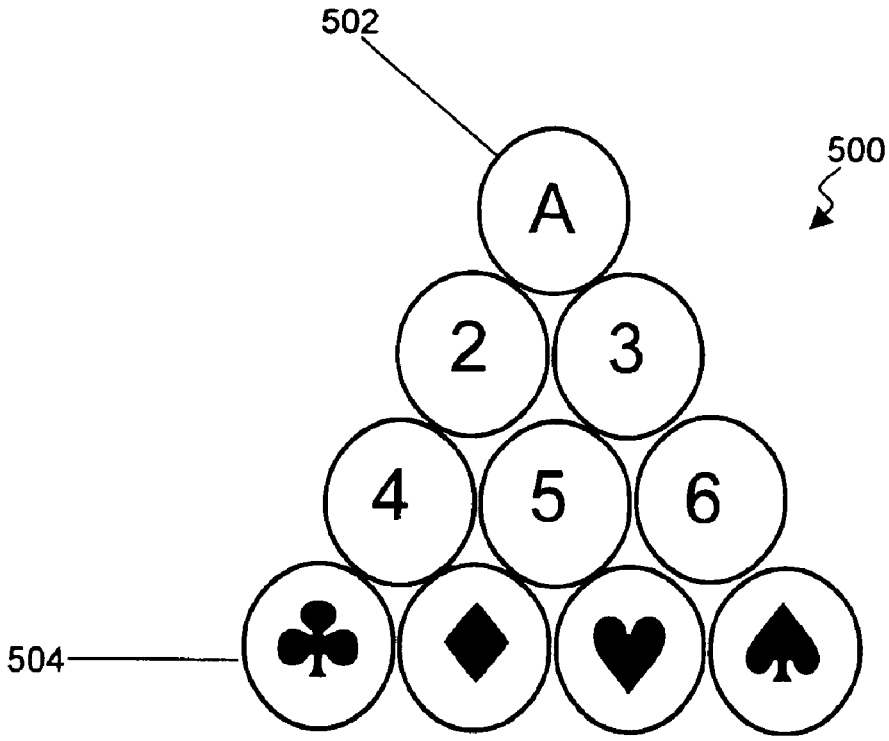
FIG. 5 is a one aspect of a player keypad for making wagers.

Referring now to FIG. 5, a stylized electronic player keypad 500 is shown by which a player may enter wagers, thereby minimizing the movements required by both the player and the dealer during the game. As will be appreciated by those of ordinary skill in the art, the configuration may be changed without affecting the functionality of the keypad. A player may select any of the particular craps bets on the table by use of the keypad 500. For Example to place the NoCall aces be discussed above the player would press Ace 502, Spade 504, Ace 502, and Spade 504 on the player key pad 500. This process would give the player the bet represented in FIG. 3 indicia 302. The same process could be used to select the bet represented in FIG. 3 indicia 304 for deuces. As one of ordinary skill in the art would understand a player would be able to select any bet represented in FIGS. 1 and 3 using the player keypad 500.

Figure 6:
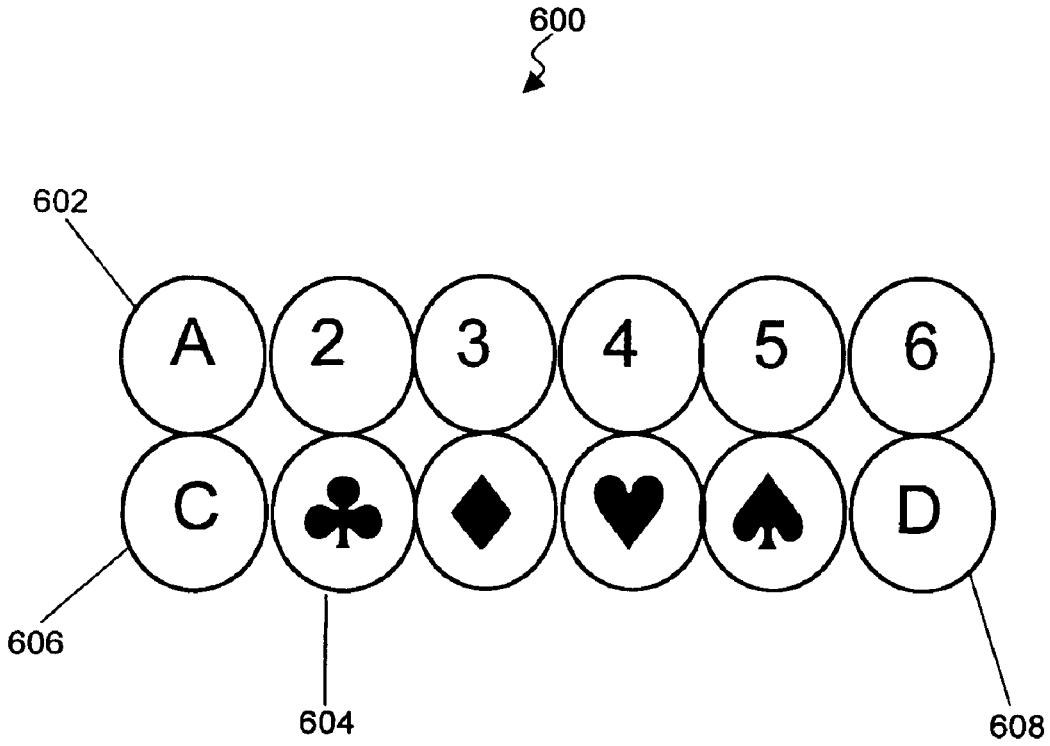
FIG. 6 is a one aspect of a dealer keypad for controlling the game.

Referring now to FIG. 6, a stylized electronic dealer keypad 600 is shown by which the dealer may enter the actual "roll" of the cards into the system, thereby minimizing the movements required by both the player and the dealer during the game. As will be appreciated by those of ordinary skill in the art, the configuration may be changed without affecting the functionality of the dealer keypad. A dealer may input any of the possible "rolls" by use of the dealer keypad 600. The dealer may input the NoCall aces roll discussed above by pressing Ace 602, Spade 604, Ace 602, and Spade 604 on the dealer key pad 600. This process would input the "roll" represented in FIG. 3 indicia 302. The same process could be used to input the "roll" represented in FIG. 3 indicia 304 for deuces. As one of ordinary skill in the art would understand a player would be able to select any bet represented in FIGS. 1 and 3 using the dealer keypad 600.

Further, when the Craps portion of the game is played manually, the dealer keypad 600 allows the dealer to press the "call" thereby automatically deleting all NoCall bets on the board. The dealer keypad 600 also includes a delete button 608, which allows the dealer to correct any inadvertent entries into the dealer keypad 600.

Figure 7:
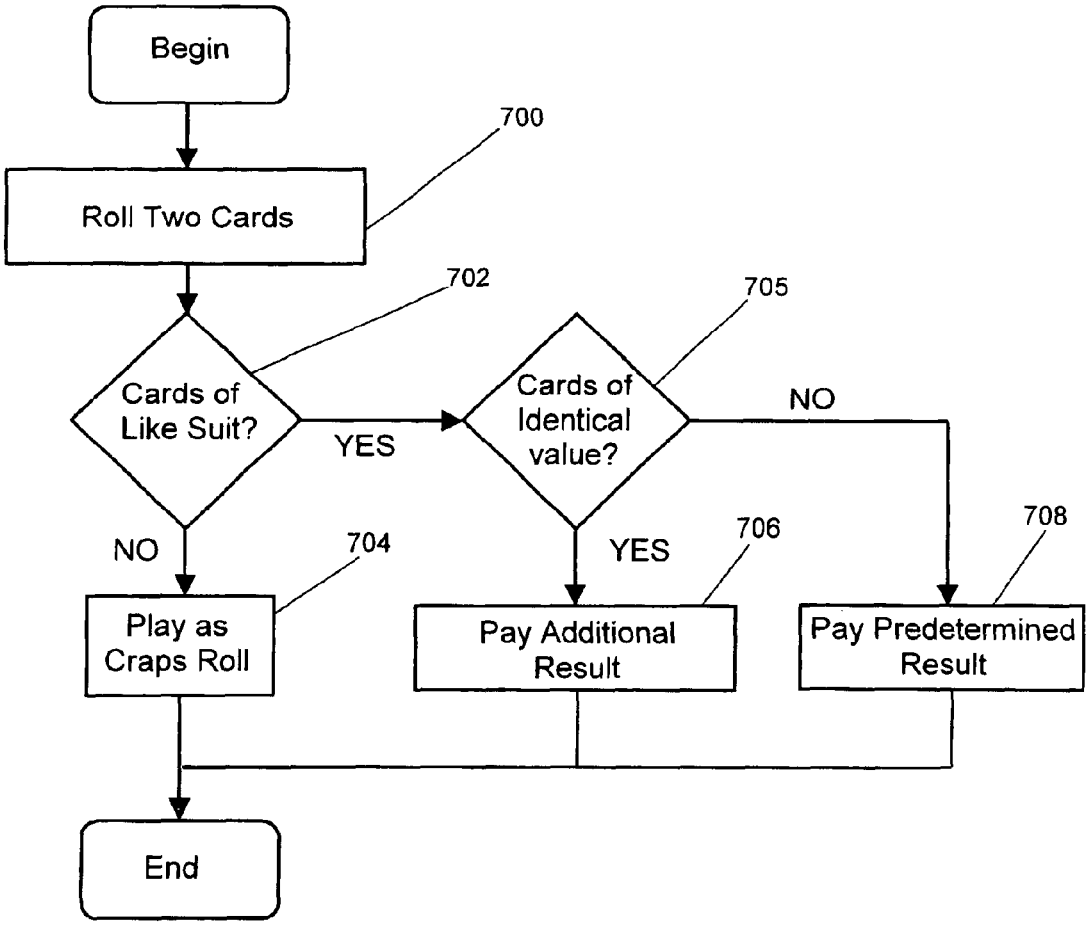
FIG. 7 is a flowchart of a second disclosed aspect of a dice-less Craps game.

Referring now to FIG. 7, a flowchart of one aspect of a disclosed dice-less Craps game is shown. The method of FIG. 7 may be played on the playing surface 300 of FIG. 3.

Beginning with act 700, two cards are dealt. In a manual version of the disclosed game, a dealer may deal the card. In a simulated game, the cards may be dealt under computer control. The cards may be manually shuffled by a dealer, an automatic shuffling machine, or by a computer.

In one aspect of a disclosed game, the deck of cards from which the pair of cards in act 700 is dealt comprises a 48-card deck. In the deck, six denominations of cards are provided which correspond to the indicia of a die, e.g., 1 through 6. For each of the six numbers, eight cards are provided, for a total of 48 cards. In one disclosed aspect, standard playing cards are used with the denominations being Ace, 2, 3, 4, 5, and 6.

As mentioned above, one defect of the games of the prior art is that the odds of dice-less Craps games do not resemble those of true dice Craps. The game of the present disclosure achieves a much closer approximation of true dice Craps by utilizing the suits already present in a standard deck of cards. In one aspect of a disclosed game, the following deck may be provided as shown above in Table 1.

To better track the odds of true dice Craps, after a pair of cards are dealt in act 700, it is determined whether the cards as dealt are of the same suit in query 702. If the dealt cards are not of a like suit, the dealt cards are treated as a "roll" of dice. The face value of the dealt cards are added together and played as a roll of the dice according to the rules of Craps in act 704. The dealer may then pay any wagers according to standard Craps rules.

If the query 702 determines that the dealt cards are of a like suit, a NoCall is declared, as described above. However, in this embodiment, a secondary criteria may be employed to provide for an additional bet. In one disclosed embodiment this additional criteria is the drawn cards having identical value.

The game proceeds to query 705 determines whether the dealt cards are of identical value. If the cards are identical, the game proceeds to act 706 where an additional wager may be paid. If the additional criteria is not met, the game proceeds to act 708, where the NoCall wager may be paid, and any wager placed on the additional criteria collected. It is to be understood that criteria other than identical value may be employed in the present disclosure. For example, wagers on suits or predetermined values may be placed on the game surface as disclosed above. Additionally, it is contemplated that one or more additional cards may be drawn to play a craps roll after either act 706 or 708.

In a further aspect of a disclosed game, after a roll is resolved in act 704, or a NoCall is resolved in act 706 or act 708, the pair of dealt cards may be returned to the deck and reshuffled, further insuring the odds remain true.

Though cards from a standard deck of cards are used in one disclosed aspect, it is contemplated that cards with any indicia suitable for representing dice indicia and suits may be used. For example, cards with other numeric indicia may be used, such as representations of the face of dice, or stylized numerals. The suits may be represented by means other than the suits of standard playing cards, such as colors or other symbols. Additionally, the cards may be of any size or shape. As will be appreciated by those of ordinary skill in the art, the number of suits may be altered to change the odds of a NoCall to achieve a desired result, such as the overall odds of the game.

Exemplary Procedure for a Dice-less Craps Game

The following description illustrates but one method of playing a dice-less Craps game. The values in the following table are provided as examples only, and the stated odds may be adjusted to suit individual applications without departing from the inventive concepts disclosed herein. In the following example, it is contemplated that at least one player will play the disclosed game.

Furthermore, there may be one dealer. As mentioned above, in a manual aspect of a disclosed game, one dealer may be used to administer the disclosed game. As will be appreciated by those of ordinary skill in the art, traditional Craps games typically require more than one person to attend to a Craps table, sometimes requiring as many a four attendants. Thus, by utilizing a game as shown and described herein, a casino may realize a substantial saving in personnel costs.

If the disclosed game is computerized, the dealer as indicated below will represent the computer hosting the game.

Place Wagers

Initially, the one or more players who desire to play the disclosed game may place wagers on a playing surface such as playing surface 100 or playing surface 300 as disclosed above. Players may make standard Craps wagers, or players may wager on the NoCall aspect of the game.

The dealer may indicate that "All Bets are set", at which point no more bets will be accepted.

Deal Cards: Determine NoCall

The dealer may shuffle and cut the cards. The dealer will then deal two cards which will total 2 to 12.

If the cards are of a like suit, a NoCall will be declared. If a NoCall is declared, the dealer will pay any NoCall wagers placed on the table, and the process starts over with the cards being returned to the deck.

If the dealt cards are not of a like suit, a NoCall is not declared, and the dealer may take any NoCall wagers. The dealt cards are then treated as a Craps "roll", with the numerical values of the cards representing the dice roll in dice Craps.

Come-out Roll

As is known by those of ordinary skill in the art, the first roll in a dice Craps game is known as the "come out roll". Table 2 illustrates possible actions on a come out roll:

TABLE 2

| Roll | Dealer Pays | Dealer Takes |
|---|---|---|
| Seven (1-6 or 6-1, 2-5 or 5-2, 3-4 or 4-3) | Pass Line; Any Seven | Big 6-8; Field; Don't Pass; Losing Proposition wagers |
| Eleven (6-5 or 5-6) | Pass Line; Field; Winning Proposition wagers | Big 6-8; Don't Pass; Losing Proposition wagers |
| Two, Three, or Twelve (Craps) (1-1, 1-2 or 2-1, 6-6) | Don't Pass Line; Field; Winning Proposition wagers | Pass Line; Losing Proposition wagers |
| Four (1-3 or 3-1 or 2-2) Dealer places Don't Pass wagers behind 4, and marks the Point 4 | Field; Winning Proposition wagers; Come bets on 4 | Don't Pass wagers behind 4; Losing Proposition wagers |
| Five (1-4 or 4-1, 2-3 or 3-2) Dealer places Don't Pass wagers behind 5, and marks the Point 5 | Come bets on 5 | Don't Pass wagers behind 5; Losing Proposition wagers Field |
| Six (1-6 or 6-1, 2-4 or 4-2, 3-3) Dealer places Don't Pass wagers behind 6, and marks the Point 6 | Winning Proposition wagers; Come bets on 6 Hard Ways (if 3-3) Big 6 | Don't Pass wagers behind 6; Losing Proposition wagers Field |
| Eight (2-6 or 6-2, 3-5 or 5-3, 4-4) Dealer places Don't Pass wagers behind 8, and marks the Point 8 | Winning Proposition wagers; Come bets on 8 Hard Ways (if 4-4) Big 8 | Don't Pass wagers behind 8; Losing Proposition wagers Field |
| Nine (3-6 or 6-3, 4-5 or 5-4) Dealer places Don't Pass wagers behind 9, and marks the Point 9 | Field; Come bets on 9 | Don't Pass wagers behind 9; Losing Proposition wagers |

TABLE 2-continued

| Roll | Dealer Pays | Dealer Takes |
|---|---|---|
| Ten (4-6 or 6-4, 5-5) Dealer places Don't Pass wagers behind 10, and marks the Point 10 | Field; Come bets on 10; Hard Ways (if 5-5); Winning Proposition wagers | Don't Pass wagers behind 10; Losing Proposition wagers |

Roll After a Point is Established

Table 3 illustrates possible actions on a roll after a point is established:

TABLE 3

| Roll | Dealer Pays | Dealer Takes |
|---|---|---|
| Seven (1-6 or 6-1, 2-5 or 5-2, 3-4 or 4-3) | Come; Any Seven; All Don't Pass wagers behind numbers and move them to Don't Come/Don't Pass line in front of each respective player | Big 6-8; Field; Don't Come; Losing Proposition wagers |
| Eleven (6-5 or 5-6) | Field; Come; Winning Proposition wagers | Big 6-8; Don't Come; Losing Proposition wagers |
| Two, Three, or Twelve (Craps) (1-1, 1-2 or 2-1, 6-6) | Don't Come; Field; Winning Proposition wagers | Come Losing Proposition wagers |
| Four (1-3 or 3-1 or 2-2) Dealer places Don't Pass wagers behind 4; place new Come wagers on 4 | Field; Winning Proposition wagers; Come bets on 4; Pay Place wagers | Don't Pass wagers behind 4; Losing Proposition wagers |
| Five (1-4 or 4-1, 2-3 or 3-2) Dealer places Don't Pass wagers behind 5; place new come wagers on 5 | Winning Proposition wagers; Come bets on 5 | Don't Pass wagers behind 5; Losing Proposition wagers Field |
| Six (1-6 or 6-1, 2-4 or 4-2, 3-3) Dealer places Don't Pass wagers behind 6; place new Come wagers on 6 | Winning Proposition wagers; Come bets on 6; Hard Ways (if 3-3); Big 6; Pay Place wagers | Don't Pass wagers behind 6; Losing Proposition wagers; Field |
| Eight (2-6 or 6-2, 3-5 or 5-3, 4-4) Dealer places Don't Pass wagers behind 8; place new Come wagers on 8 | Winning Proposition wagers; Come bets on 8; Hard Ways (if 4-4); Big 8; Pay Place wagers | Don't Pass wagers behind 8; Losing Proposition wagers Field |
| Nine (3-6 or 6-3, 4-5 or 5-4) Dealer places Don't Pass wagers behind 9; place new Come wagers on 9 | Field; Come bets on 9; Pay Place wagers | Don't Pass wagers behind 9; Losing Proposition wagers |
| Ten (4-6 or 6-4, 5-5) Dealer places Don't Pass wagers behind 10; place new Come wagers on 10 | Field; Come bets on 10; Hard Ways (if 5-5); Winning Proposition wagers | Don't Pass wagers behind 10; Losing Proposition wagers |

The previous disclosure is provided to enable any person skilled in the art to make or use the present invention. The various modifications will be readily apparent to those skilled in the art, and the generic principles defined herein may be applied to other embodiments without the use of the inventive faculty. Thus, the present disclosure is not intended to be limited to the embodiments shown herein but is to be accorded the widest scope consistent with the principles and novel features disclosed herein.

What is claimed is:

1. A method of playing a dice-less Craps game with a plurality of cards wherein said plurality of cards are divided into at least two suits comprising:

dealing a first card and a second card from said plurality of cards;

determining whether said first card and said second card are of the same suit;

if said first and second cards are not of the same suit, then adding said numerical values of said first card and said second card to determine a roll in accordance with the rules of Craps;

if said first and second cards are of the same suit, then paying a predetermined result;

determining whether said first and second cards match an additional criteria; and if said first and second cards match an additional criteria, paying an additional result.

2. The method of claim 1, wherein said additional criteria comprises said first and second cards having identical values.

3. The method of claim 1, wherein said additional criteria comprises said first and second cards having predetermined values.

4. The method of claim 1, wherein said additional criteria comprises said first and second cards having a predetermined suit.

5. The method of claim 4, initially including the act of placing, by at least one player, wagers that said additional criteria will occur.

6. The method of claim 5, further including the act of paying, by said dealer, wagers in accordance with said additional criteria.

7. The method of claim 1, wherein said pair of cards are drawn from a deck consisting of 48 cards including four like-suited pairs each of Aces, Twos, Threes, Fours, Fives, and Sixes.

8. The method of claim 7, wherein said dealt pair of cards are returned to said deck prior to said dealer dealing a subsequent pair of cards.

* * * * *